US007568769B1

(12) United States Patent
Chuang

(10) Patent No.: US 7,568,769 B1
(45) Date of Patent: Aug. 4, 2009

(54) ELASTIC SUPPORT ASSEMBLY FOR CHAIR

(76) Inventor: Teng-Fu Chuang, 156, Sec. 1, Jhongsi Rd., Sijhou Township, Changhua County (TW)

( * ) Notice: Subject to any disclaimer, the term of this patent is extended or adjusted under 35 U.S.C. 154(b) by 0 days.

(21) Appl. No.: 12/203,334

(22) Filed: Sep. 3, 2008

(51) Int. Cl.
*A47C 7/02* (2006.01)

(52) U.S. Cl. ..... 297/452.63; 297/452.58

(58) Field of Classification Search ..... 297/452.63, 297/452.56, 463.1, 463.2; 160/392, 393, 160/DIG. 15; 24/300, 301, 265 C, 265 R
See application file for complete search history.

(56) References Cited

U.S. PATENT DOCUMENTS 3,175,269 A * 3/1965 Raduns et al. ..... 24/265 C
6,056,367 A * 5/2000 Hsiao ..... 297/452.63
6,074,013 A * 6/2000 Hsiao ..... 297/440.1
7,226,130 B2 * 6/2007 Tubergen et al. ..... 297/452.63
2008/0238177 A1 * 10/2008 Hsiao ..... 297/452.63 X

* cited by examiner

*Primary Examiner*—Anthony D Barfield
(74) *Attorney, Agent, or Firm*—Banger Shia

(57) ABSTRACT

An elastic support assembly for a chair includes two opposite mounting members each attached to the chair, a flat elastic strip mounted between the mounting members, and a circular elastic cord mounted between the mounting members. Thus, the flat elastic strip and the circular elastic cord are mounted between the mounting members to reinforce the strength of the elastic support assembly so that the elastic support assembly has a greater strength to withstand a larger load. In addition, the flat elastic strip co-operates with the circular elastic cord to support the mounting members so that the elastic support assembly is not deformed or distorted easily during a long-term utilization or due to a heavier load, thereby greatly enhancing the lifetime of the elastic support assembly.

19 Claims, 4 Drawing Sheets

ELASTIC SUPPORT ASSEMBLY FOR CHAIR

BACKGROUND OF THE INVENTION

1. Field of the Invention

The present invention relates to an elastic support assembly and, more particularly, to an elastic support assembly for a chair and the like.

2. Description of the Related Art

A conventional elastic support assembly for a chair comprises two opposite mounting members each attached to the chair, and a circular elastic cord mounted between the mounting members. Each of the mounting members is provided with two circular holes to allow passage of the circular elastic cord. The circular elastic cord has two opposite ends each extending through the two circular holes of a respective one of the mounting members. Each of the two opposite ends of the circular elastic cord is fastened by a binding wire so that each of the two opposite ends of the circular elastic cord is secured in the respective mounting member by the binding wire. However, the elastic support assembly only comprises a single circular elastic cord mounted between the mounting members so that the elastic support assembly has a smaller strength and cannot withstand a larger load. In addition, the circular elastic cord is deformed or distorted easily during a long-term utilization or due to a heavier load, thereby greatly decreasing the lifetime of the elastic support assembly.

BRIEF SUMMARY OF THE INVENTION

In accordance with the present invention, there is provided an elastic support assembly for a chair, comprising two opposite mounting members, a flat elastic strip mounted between the two mounting members, and a circular elastic cord mounted between the two mounting members.

The primary objective of the present invention is to provide an elastic support assembly for a chair, wherein the flat elastic strip and the circular elastic cord are mounted between the two mounting members to reinforce the strength of the elastic support assembly so that the elastic support assembly has a greater strength to withstand a larger load.

Another objective of the present invention is to provide an elastic support assembly for a chair, wherein the flat elastic strip co-operates with the circular elastic cord to support the two mounting members so that the elastic support assembly is not deformed or distorted easily during a long-term utilization or due to a heavier load, thereby greatly enhancing the lifetime of the elastic support assembly.

A further objective of the present invention is to provide an elastic support assembly for a chair, wherein the flat elastic strip co-operates with the circular elastic cord to increase the elasticity of the elastic support assembly so that the elastic support assembly has a greater elasticity, thereby providing a comfortable sensation to a user.

A further objective of the present invention is to provide an elastic support assembly for a chair, wherein the flat elastic strip and the circular elastic cord are locked by the two locking snaps the two binding strings respectively so that the flat elastic strip and the circular elastic cord are mounted between the two mounting members solidly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
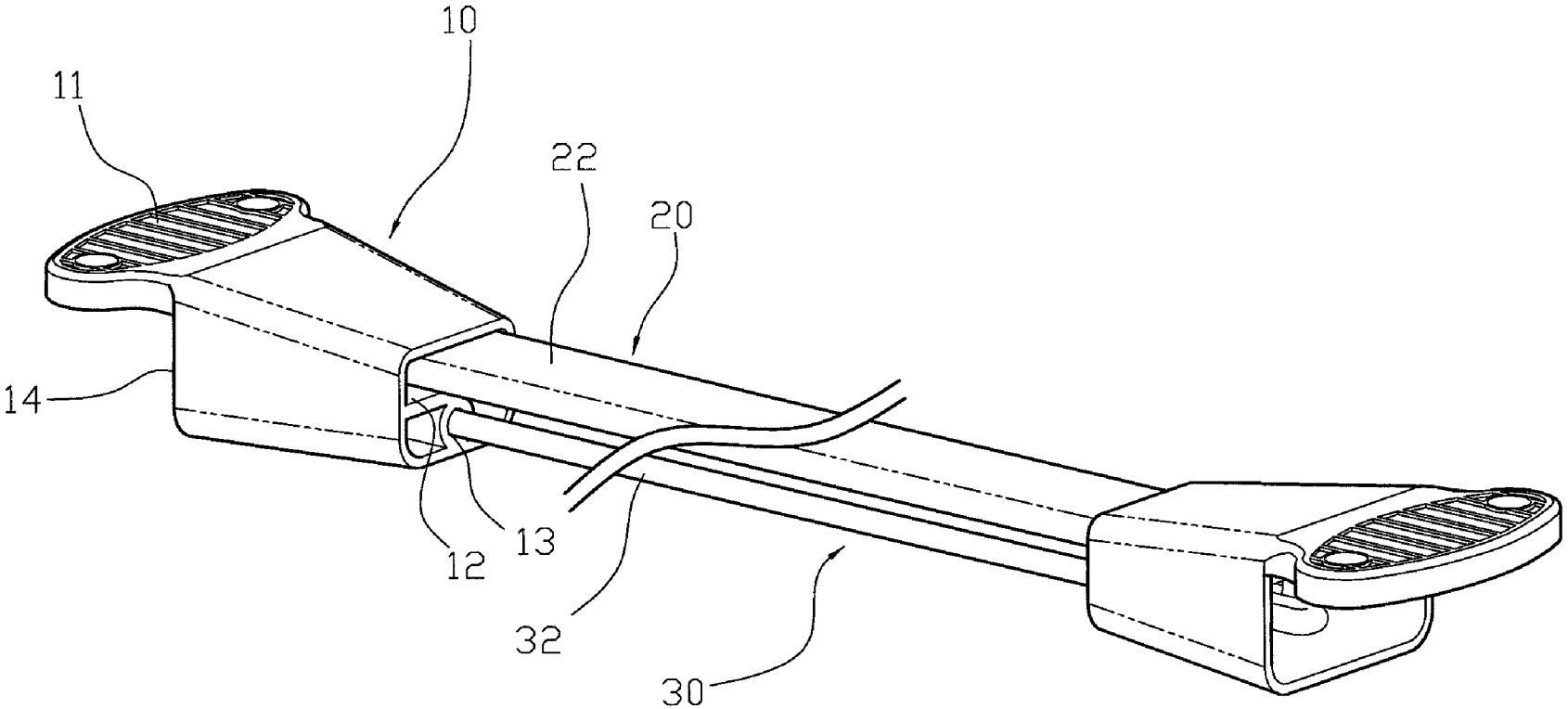
FIG. 1 is a perspective view of an elastic support assembly in accordance with the preferred embodiment of the present invention.
Figure 2:
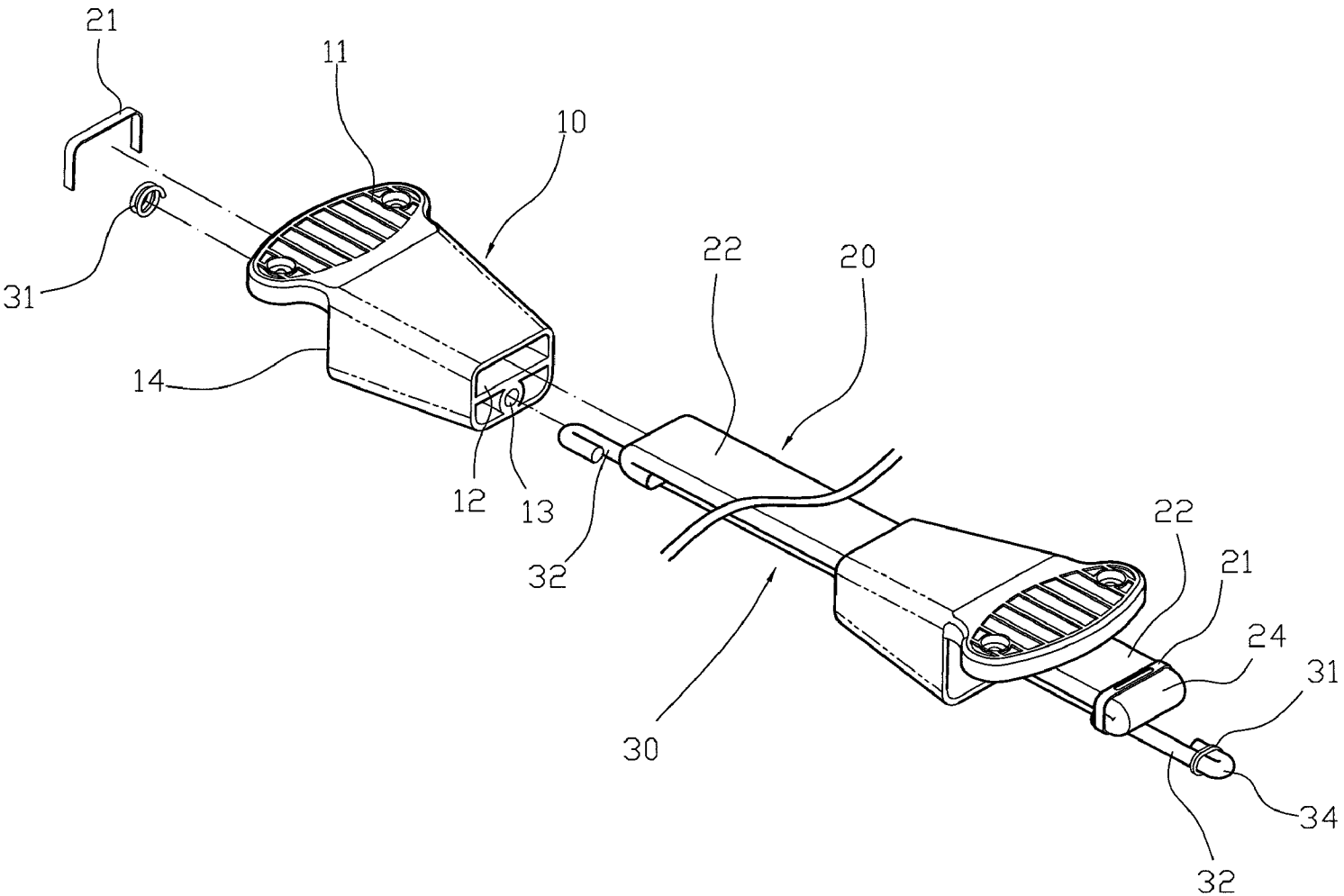
FIG. 2 is a partially exploded perspective view of the elastic support assembly as shown in FIG. 1.
Figure 4:
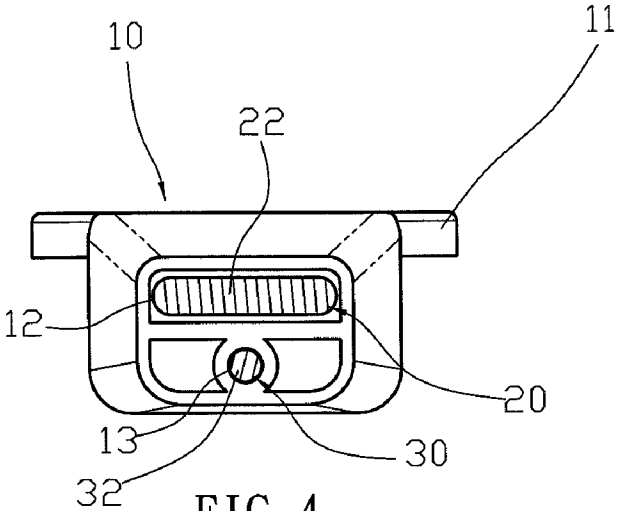
FIG. 4 is a side cross-sectional view of the elastic support assembly as shown in FIG. 1.
Figure 3:
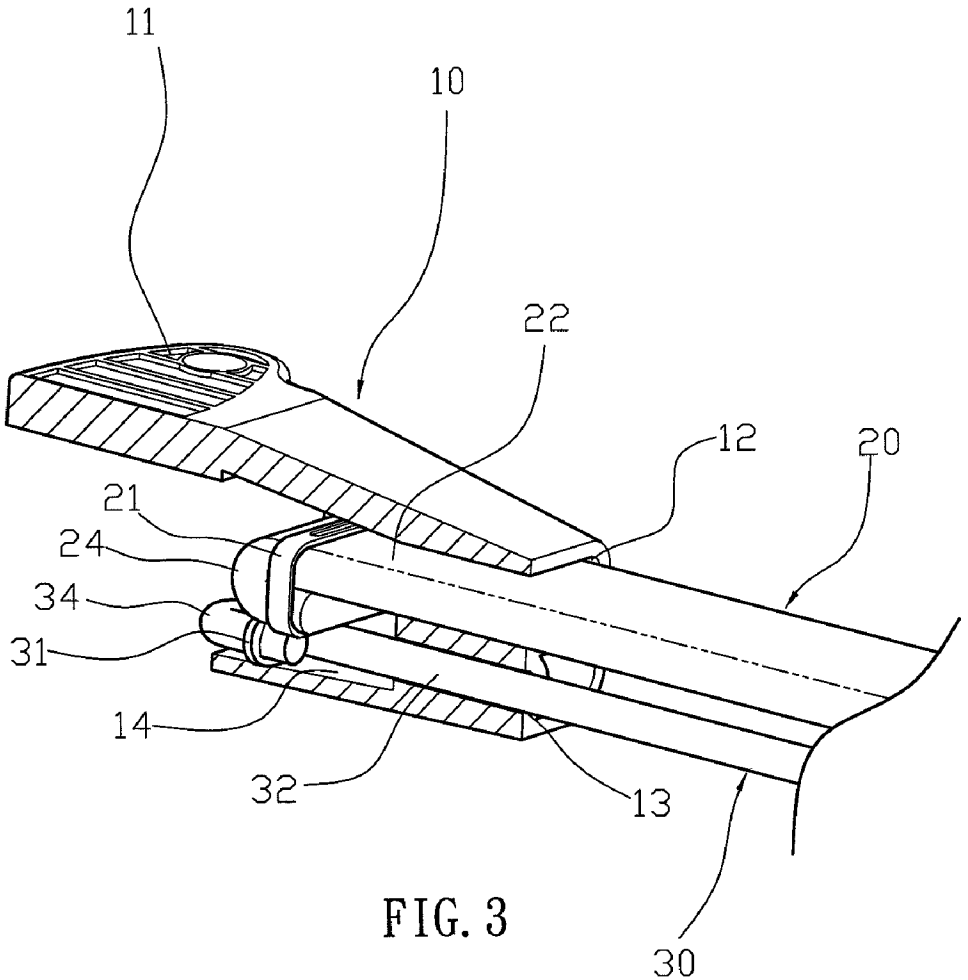
FIG. 3 is a partially perspective cross-sectional view of the elastic support assembly as shown in FIG. 1.

Referring to the drawings and initially to FIGS. 1-4, an elastic support assembly for a chair in accordance with the preferred embodiment of the present invention comprises two opposite mounting members 10, a flat elastic strip 20 mounted between the two mounting members 10, and a circular elastic cord 30 mounted between the two mounting members 10.

Each of the two mounting members 10 has a first side provided with a flat through hole 12 to allow passage of the flat elastic strip 20 and a circular through hole 13 to allow passage of the circular elastic cord 30. The flat through hole 12 and the circular through hole 13 of each of the two mounting members 10 are parallel with each other. Each of the flat through hole 12 and the circular through hole 13 extends in a longitudinal direction of each of the two mounting members 10. Each of the two mounting members 10 has a second side provided with a receiving chamber 14 to receive the flat elastic strip 20 and the circular elastic cord 30. The receiving chamber 14 of each of the two mounting members 10 is connected to the flat through hole 12 and the circular through hole 13. The receiving chamber 14 of each of the two mounting members 10 has a size greater than that of each of the flat through hole 12 and the circular through hole 13. The second side of each of the two mounting members 10 is provided with a protruding locking plate 11 protruding outwardly from the receiving chamber 14.

The flat elastic strip 20 has a size flush with that of the flat through hole 12 of each of the two mounting members 10. The flat elastic strip 20 has two opposite ends 22 each extending through the flat through hole 12 into the receiving chamber 14 of a respective one of the two mounting members 10. Each of the two opposite ends 22 of the flat elastic strip 20 is provided with an enlarged head portion 24 received in the receiving chamber 14 of the respective mounting member 10. The enlarged head portion 24 of each of the two opposite ends 22 of the flat elastic strip 20 has a bent shape. The enlarged head portion 24 of each of the two opposite ends 22 of the flat elastic strip 20 protrudes outwardly from the flat through hole 12 of each of the respective mounting member 10 and has a size greater than that of the flat through hole 12 of the respective mounting member 10.

The circular elastic cord 30 has a size flush with that of the circular through hole 13 of each of the two mounting members 10. The circular elastic cord 30 has two opposite ends 32 each extending through the circular through hole 13 into the receiving chamber 14 of a respective one of the two mounting members 10. Each of the two opposite ends 32 of the circular elastic cord 30 is provided with an enlarged head portion 34 received in the receiving chamber 14 of the respective mounting member 10. The enlarged head portion 34 of each of the two opposite ends 32 of the circular elastic cord 30 has a bent shape. The enlarged head portion 34 of each of the two opposite ends 32 of the circular elastic cord 30 protrudes outwardly from the circular through hole 13 of the respective mounting member 10 and has a size greater than that of the circular through hole 13 of the respective mounting member 10.

The elastic support assembly further comprises two locking snaps 21 each locked onto the enlarged head portion 24 of a respective one of the two opposite ends 22 of the flat elastic strip 20, and two binding strings 31 each locked onto the enlarged head portion 34 of a respective one of the two opposite ends 32 of the circular elastic cord 30.

In assembly, each of the two opposite ends 22 of the flat elastic strip 20 extends through the flat through hole 12 into the receiving chamber 14 of a respective one of the two mounting members 10. Then, each of the two opposite ends 22 of the flat elastic strip 20 is bent to form the enlarged head portion 24. Then, each of the two locking snaps 21 is locked onto the enlarged head portion 24 of a respective one of the two opposite ends 22 of the flat elastic strip 20. Then, each of the two opposite ends 32 of the circular elastic cord 30 extends through the circular through hole 13 into the receiving chamber 14 of a respective one of the two mounting members 10. Then, each of the two opposite ends 32 of the circular elastic cord 30 is bent to form the enlarged head portion 34. Finally, each of the two binding strings 31 is locked onto the enlarged head portion 34 of a respective one of the two opposite ends 32 of the circular elastic cord 30.

Figure 5:
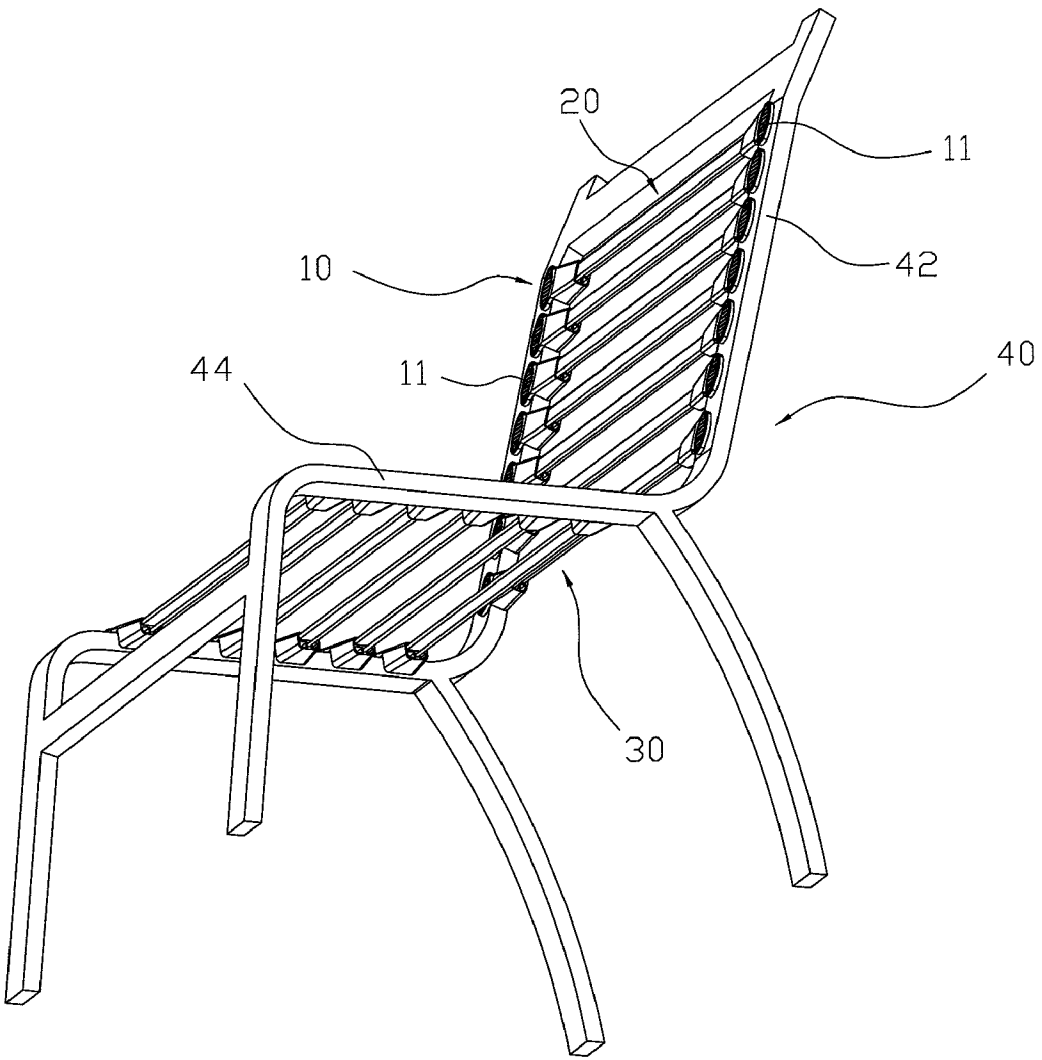
FIG. 5 is a perspective view showing the elastic support assembly for a chair in accordance with the preferred embodiment of the present invention.

As shown in FIG. 5, a plurality of elastic support assemblies are mounted on the backrest 42 and the seat 44 of a chair 40. The locking plate 11 of each of the two mounting members 10 is locked onto the backrest 42 and the seat 44 of the chair 40 to attach each of the elastic support assemblies to the backrest 42 and the seat 44 of the chair 40.

Accordingly, the flat elastic strip 20 and the circular elastic cord 30 are mounted between the two mounting members 10 to reinforce the strength of the elastic support assembly so that the elastic support assembly has a greater strength to withstand a larger load. In addition, the flat elastic strip 20 co-operates with the circular elastic cord 30 to support the two mounting members 10 so that the elastic support assembly is not deformed or distorted easily during a long-term utilization or due to a heavier load, thereby greatly enhancing the lifetime of the elastic support assembly. Further, the flat elastic strip 20 co-operates with the circular elastic cord 30 to increase the elasticity of the elastic support assembly so that the elastic support assembly has a greater elasticity, thereby providing a comfortable sensation to a user. Further, the flat elastic strip 20 and the circular elastic cord 30 are locked by the two locking snaps 21 the two binding strings 31 respectively so that the flat elastic strip 20 and the circular elastic cord 30 are mounted between the two mounting members 10 solidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An elastic support assembly, comprising:

two opposite mounting members;

a flat elastic strip mounted between the two mounting members;

a circular elastic cord mounted between the two mounting members;

wherein each of the two mounting members has a first side provided with a flat through hole to allow passage of the flat elastic strip and a circular through hole to allow passage of the circular elastic cord.

2. The elastic support assembly of claim 1, wherein the second side of each of the two mounting members is provided with a protruding locking plate protruding outwardly from the receiving chamber.

3. The elastic support assembly of claim 1, wherein the flat elastic strip has two opposite ends each extending through the flat through hole into the receiving chamber of a respective one of the two mounting members.

4. The elastic support assembly of claim 3, wherein each of the two opposite ends of the flat elastic strip is provided with an enlarged head portion received in the receiving chamber of the respective mounting member.

5. The elastic support assembly of claim 4, wherein the enlarged head portion of each of the two opposite ends of the flat elastic strip has a bent shape.

6. The elastic support assembly of claim 4, wherein the enlarged head portion of each of the two opposite ends of the flat elastic strip protrudes outwardly from the flat through hole of each of the respective mounting member.

7. The elastic support assembly of claim 4, wherein the enlarged head portion of each of the two opposite ends of the flat elastic strip has a size greater than that of the flat through hole of the respective mounting member.

8. The elastic support assembly of claim 4, further comprising:

two locking snaps each locked onto the enlarged head portion of a respective one of the two opposite ends of the flat elastic strip.

9. The elastic support assembly of claim 1, wherein the circular elastic cord has two opposite ends each extending through the circular through hole into the receiving chamber of a respective one of the two mounting members.

10. The elastic support assembly of claim 9, wherein each of the two opposite ends of the circular elastic cord is provided with an enlarged head portion received in the receiving chamber of the respective mounting member.

11. The elastic support assembly of claim 10, wherein the enlarged head portion of each of the two opposite ends of the circular elastic cord has a bent shape.

12. The elastic support assembly of claim 10, wherein the enlarged head portion of each of the two opposite ends of the circular elastic cord protrudes outwardly from the circular through hole of the respective mounting member.

13. The elastic support assembly of claim 10, wherein the enlarged head portion of each of the two opposite ends of the circular elastic cord has a size greater than that of the circular through hole of the respective mounting member.

14. The elastic support assembly of claim 10, further comprising:

two binding strings each locked onto the enlarged head portion of a respective one of the two opposite ends of the circular elastic cord.

15. The elastic support assembly of claim 1, wherein the flat elastic strip has a size flush with that of the flat through hole of each of the two mounting members;

the circular elastic cord has a size flush with that of the circular through hole of each of the two mounting members.

16. The elastic support assembly of claim 1, wherein the flat through hole and the circular through hole of each of the two mounting members are parallel with each other.

17. The elastic support assembly of claim 1, wherein the receiving chamber of each of the two mounting members is connected to the flat through hole and the circular through hole.

18. The elastic support assembly of claim 1, wherein the receiving chamber of each of the two mounting members has a size greater than that of each of the flat through hole and the circular through hole.

19. The elastic support assembly of claim 1, wherein each of the flat through hole and the circular through hole extends in a longitudinal direction of each of the two mounting members.

* * * * *